US011465302B2

(12) United States Patent
Streur et al.

(10) Patent No.: US 11,465,302 B2
(45) Date of Patent: Oct. 11, 2022

(54) ATTACHMENT FOR A PERSONAL CARE DEVICE

(71) Applicant: KONINKLIJKE PHILIPS N.V., Eindhoven (NL)

(72) Inventors: Jarno Streur, Eindhoven (NL); Johannes Hendrikus Van Toor, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 375 days.

(21) Appl. No.: 16/305,274

(22) PCT Filed: May 26, 2017

(86) PCT No.: PCT/EP2017/062768
§ 371 (c)(1),
(2) Date: Nov. 28, 2018

(87) PCT Pub. No.: WO2017/207437
PCT Pub. Date: Dec. 7, 2017

(65) Prior Publication Data

US 2020/0331158 A1 Oct. 22, 2020

(30) Foreign Application Priority Data

May 31, 2016 (EP) ..... 16172238

(51) Int. Cl.
*B26B 19/38* (2006.01)
*B26B 19/14* (2006.01)

(52) U.S. Cl.
CPC ..... *B26B 19/3813* (2013.01); *B26B 19/14* (2013.01); *B26B 19/386* (2013.01)

(58) Field of Classification Search
CPC ..... B26B 19/3813; B26B 19/00; B26B 19/14; B26B 19/38; B26B 19/386; F16B 7/042;
(Continued)

(56) References Cited

U.S. PATENT DOCUMENTS 1,315,107 A * 9/1919 Fitzpatrick ..... F16B 39/04 411/945
2,052,019 A * 8/1936 Baker ..... E21B 17/0426 411/929

(Continued)

FOREIGN PATENT DOCUMENTS

CN 202144076 U 2/2012
CN 202540335 U 11/2012

(Continued)

*Primary Examiner* — Nhat Chieu Q Do

(57) ABSTRACT

An attachment for a personal care device, such as a shaving or trimming device, is configured to be releasably coupled to a coupling structure of the personal care device by a coupler. The coupler includes a shaft having at least one coupling recess on the circumferential surface thereof. The coupling recess has a central portion and first and second side portions arranged on opposite sides of the central portion. The coupling recess also includes a sloped surface arranged in at least the central portion. When the attachment is coupled to the coupling structure, the sloped surface is engaged by a spring of the coupling structure. At least one of the first and second side portions of the coupling recess is recessed relative to the sloped surface, seen in a direction parallel to the central axis of the shaft.

9 Claims, 13 Drawing Sheets

(58) Field of Classification Search
CPC ..... F16B 7/04; F16B 7/1418; F16B 5/0275; F16B 21/20; F16B 21/125; F16B 21/16; F16B 21/18; F16B 21/02; F16B 21/04
USPC ..... 30/43.6, 43.4, 43.5, 346.51; 15/22.1; 403/349, 104, 326, 355, 315–317; 285/305, 321, 247
See application file for complete search history.

(56) References Cited

U.S. PATENT DOCUMENTS 3,363,312 A * 1/1968 Fayed ..... B26B 21/26 30/40.1
3,698,747 A * 10/1972 Wing ..... F16L 37/144 285/305
4,700,926 A * 10/1987 Hansen ..... F16L 37/42 285/305
5,098,241 A * 3/1992 Aldridge ..... F16L 37/092 285/321
5,275,425 A * 1/1994 Hessler ..... B25D 17/08 279/101
7,682,120 B1 * 3/2010 Goldbaum ..... F16B 39/122 411/551
7,832,129 B2 * 11/2010 Briscoe ..... E02F 9/2883 37/456
8,166,623 B2 * 5/2012 Balsells ..... B23P 17/00
8,261,452 B2 * 9/2012 Westerhof ..... B26B 19/14 30/43.6
RE47,515 E * 7/2019 Westerhof ..... B26B 19/3853
RE48,352 E * 12/2020 Westerhof ..... B26B 19/386
2005/0273951 A1 * 12/2005 Karl ..... A61C 17/222 15/22.1
2006/0202476 A1 * 9/2006 Eggert ..... B60T 17/043 285/305
2010/0058594 A1 * 3/2010 Westerhof ..... B26B 19/3853 30/43.4
2012/0192436 A1 8/2012 Toy
2015/0089814 A1 4/2015 Marut

FOREIGN PATENT DOCUMENTS

CN 104552360 A 4/2015
CN 204913963 U 12/2015
WO 2008062339 A1 5/2008
WO 2010034175 A1 4/2010
WO 2011055323 A1 5/2011
WO 2014191265 A1 12/2014

* cited by examiner

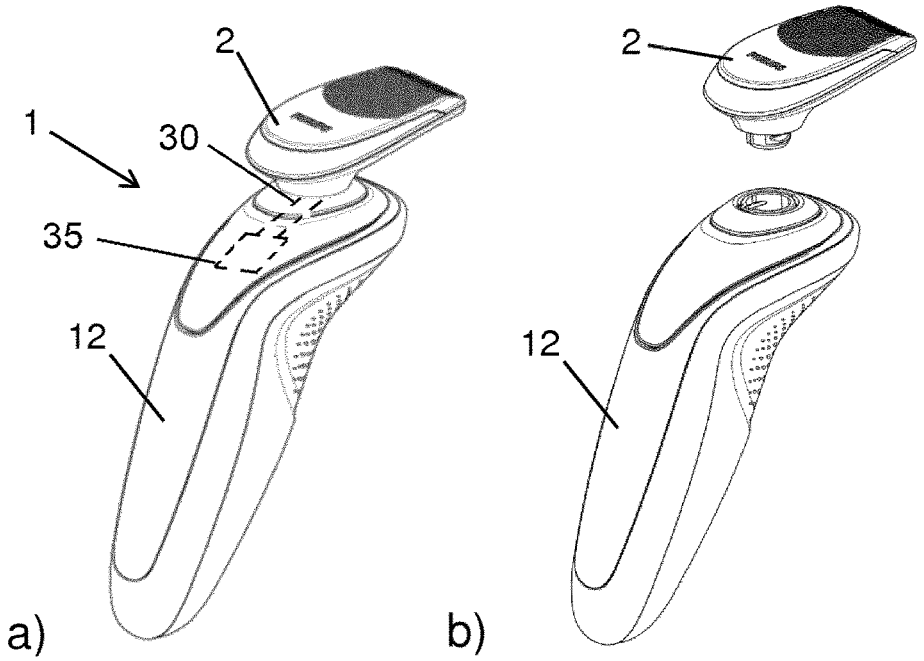
FIG. 1
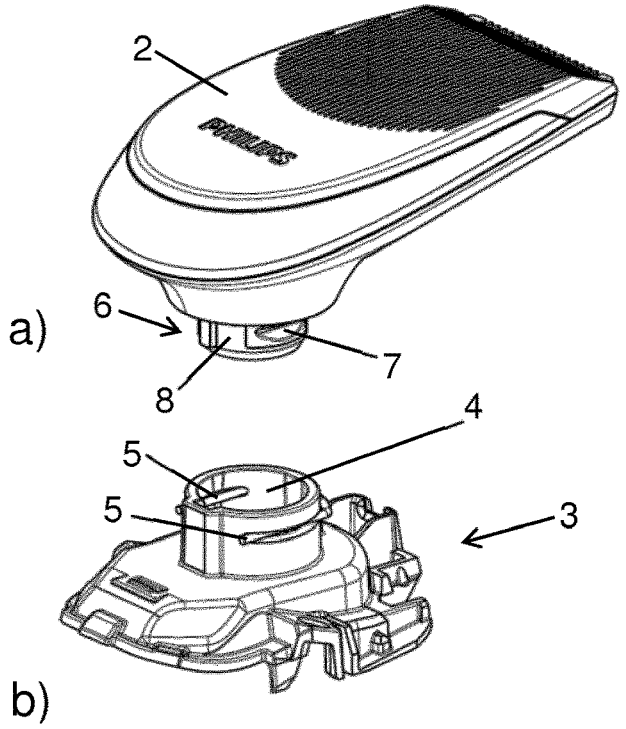
FIG. 2, prior art

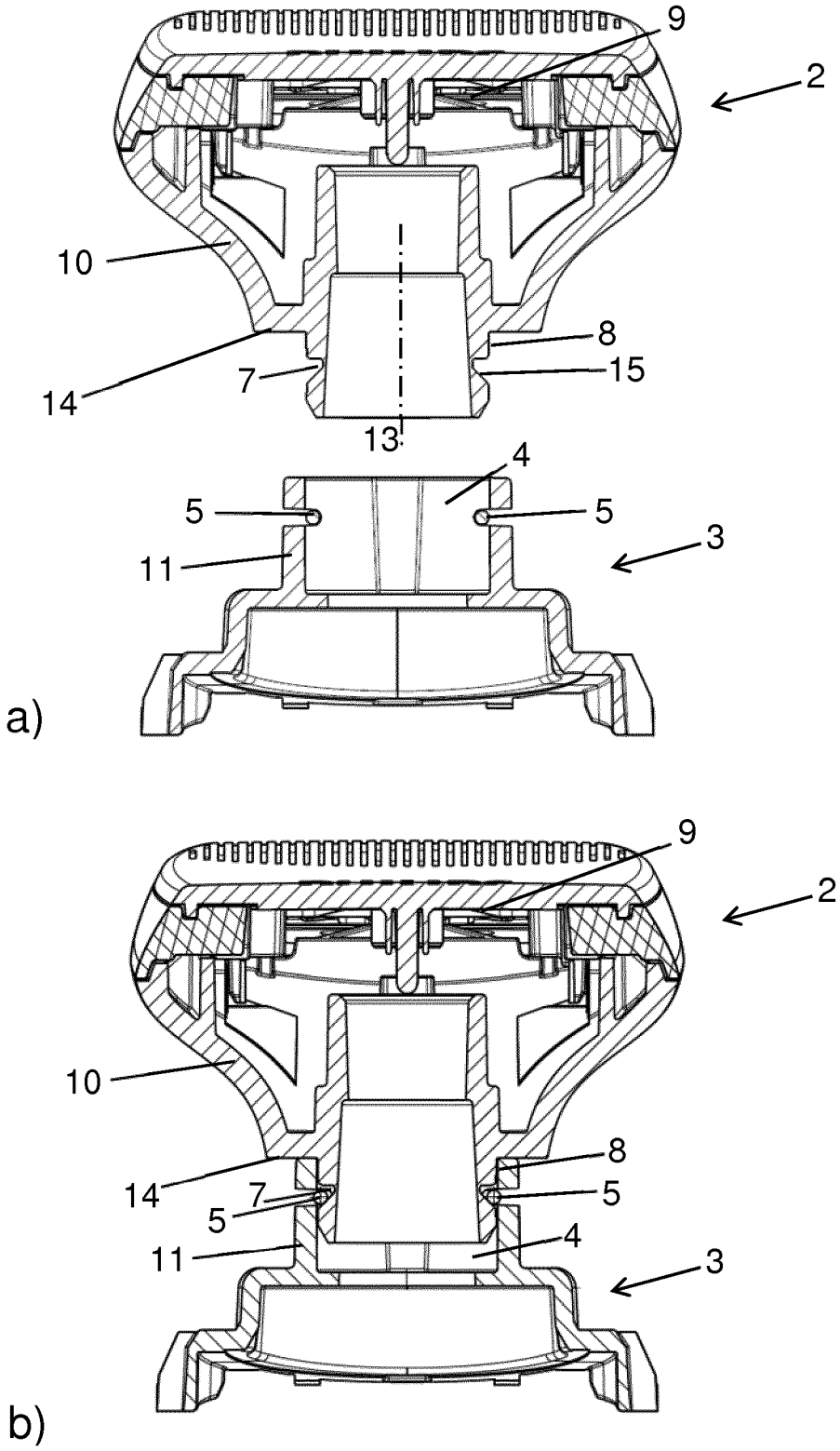
FIG. 3, prior art

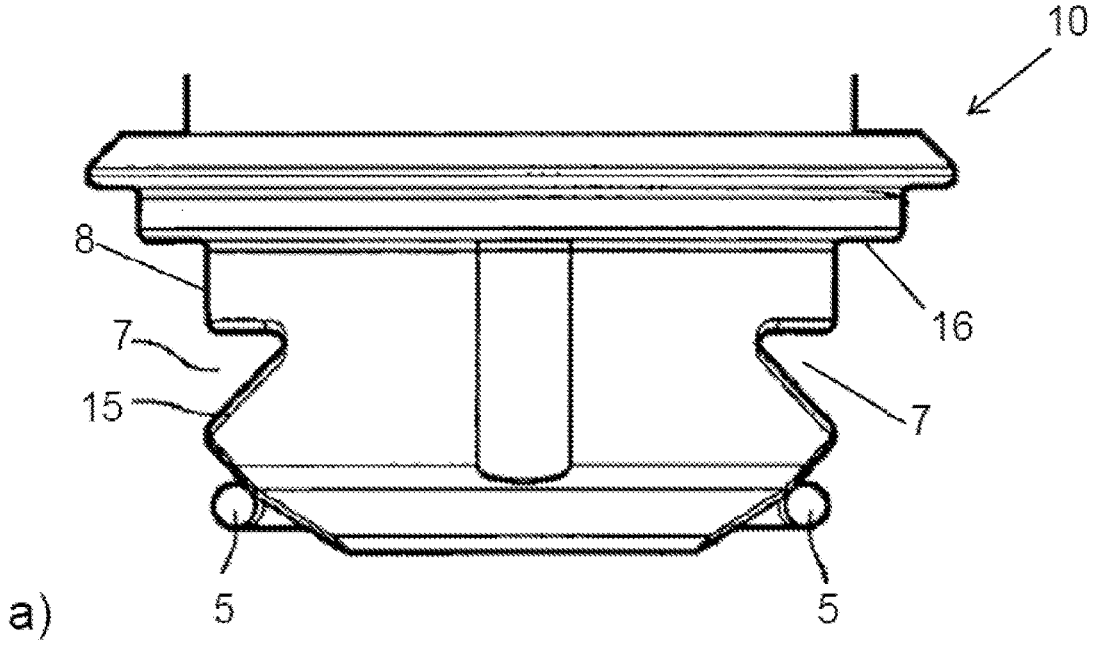
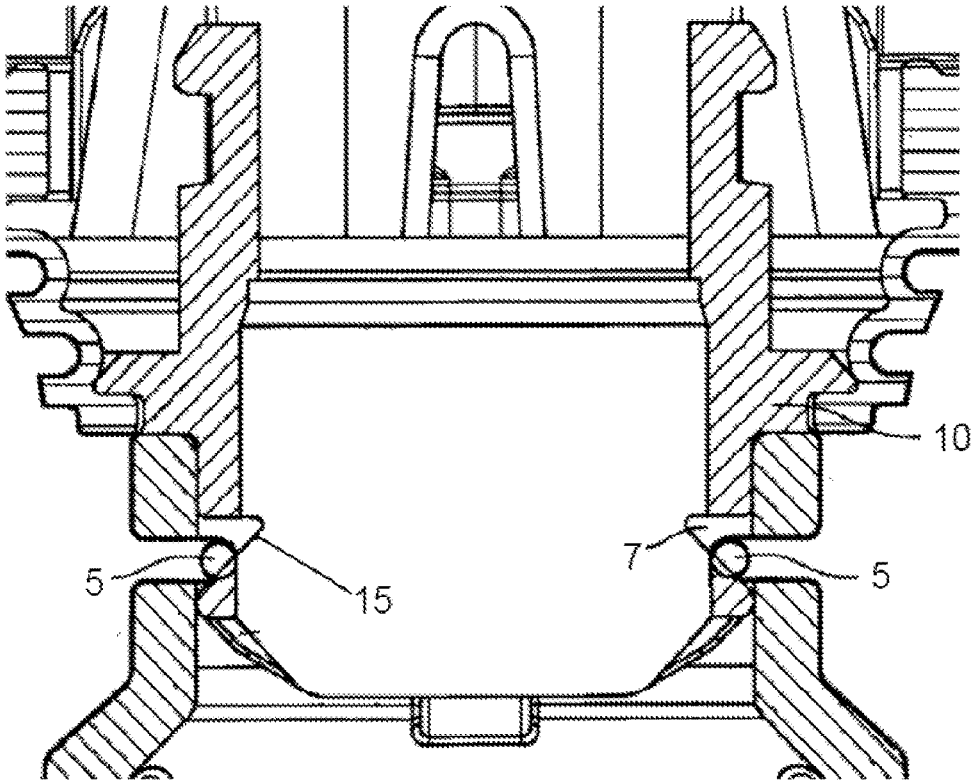
FIG. 4, prior art

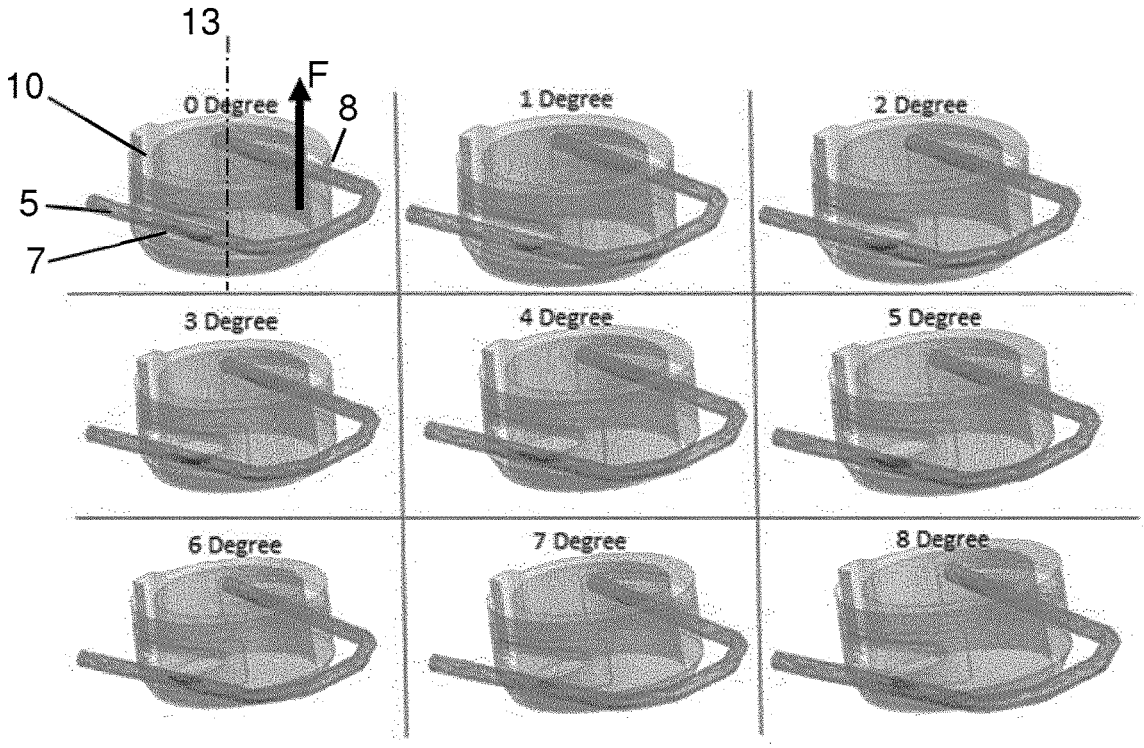
FIG. 5, prior art
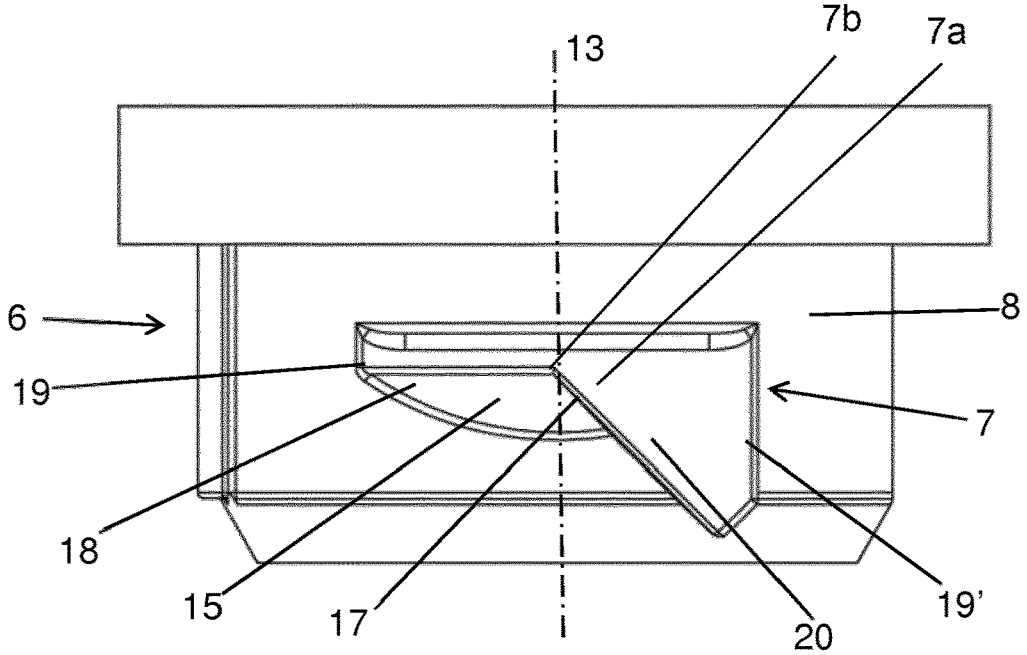
FIG. 6 a)

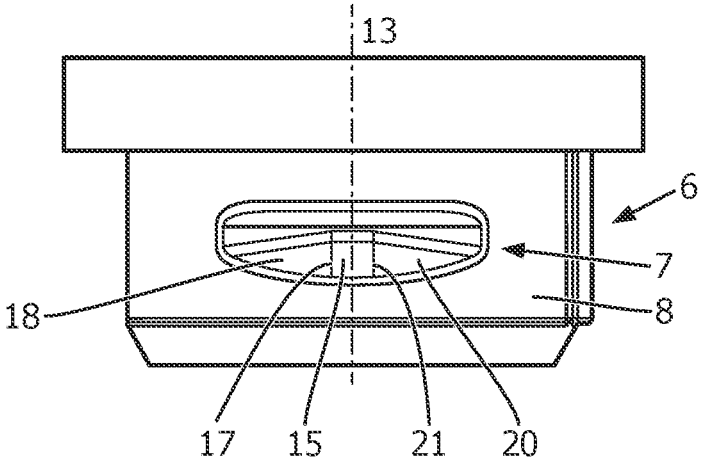
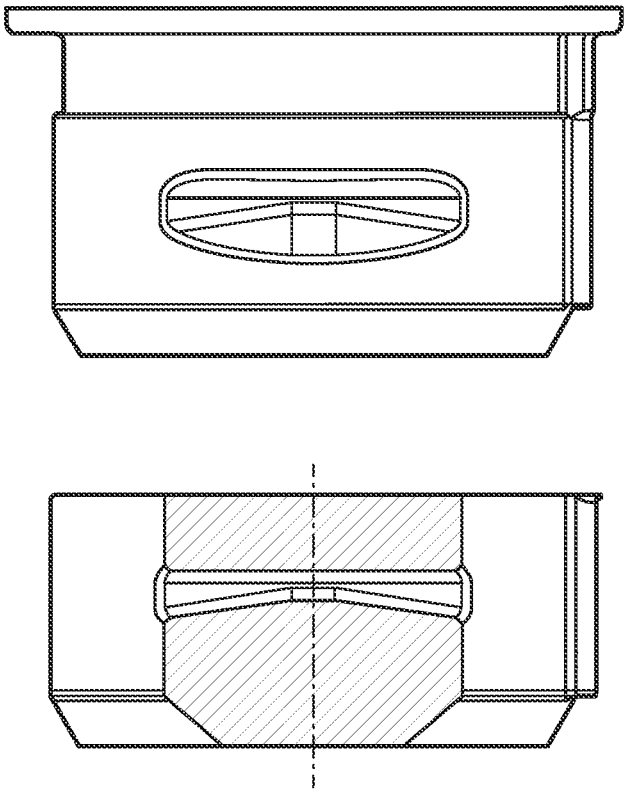
b)
FIG. 8 continued

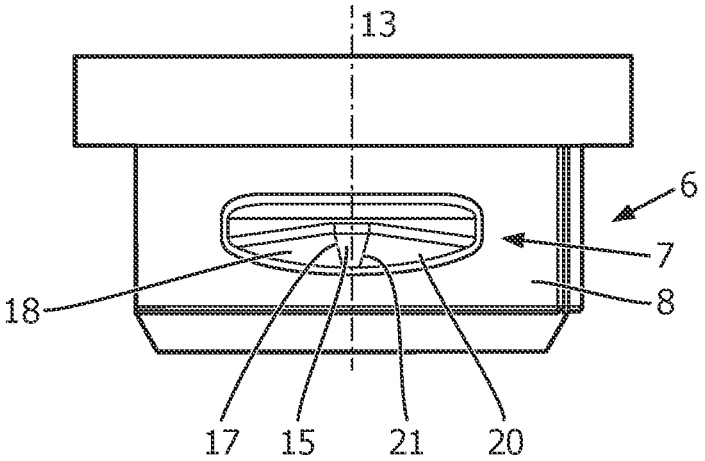
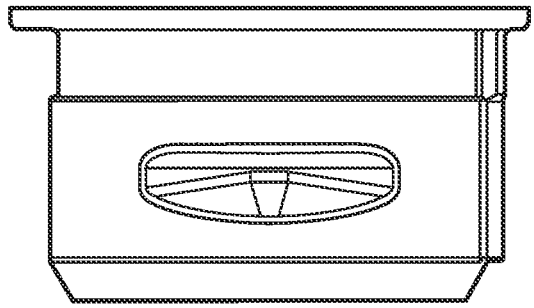
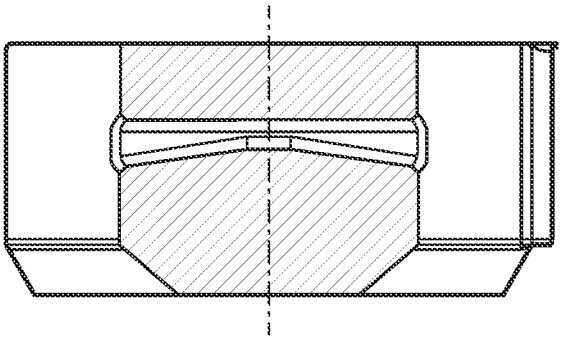
c)
FIG. 8 continued

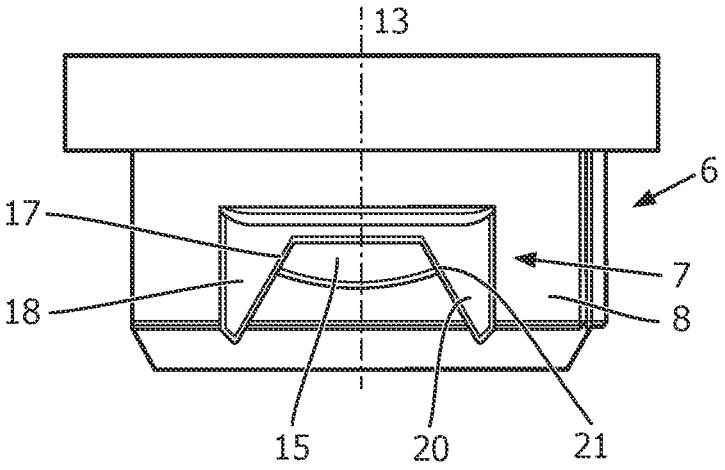
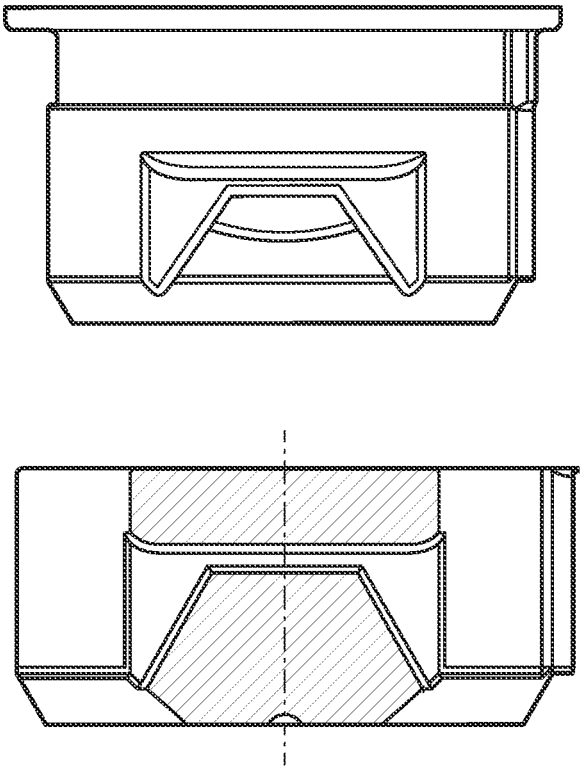
d)
FIG. 8 continued e)

f)

g)

ATTACHMENT FOR A PERSONAL CARE DEVICE

This application is the U.S. National Phase application under 35 U.S.C. § 371 of International Application No. PCT/EP2017/062768, filed on May 26, 2017, which claims the benefit of European Application No. 16172238.4 filed on May 31, 2016. These applications are hereby incorporated by reference herein.

FIELD OF THE INVENTION

The present invention relates to an attachment for a personal care device, and in particular to an attachment which can be releasably coupled to a coupling structure of a main housing of the personal care device.

BACKGROUND OF THE INVENTION

Personal care devices comprising a releasably mounted attachment include shavers, trimmers, and massagers. In such devices, the attachment can e.g. be released and replaced by a different attachment for changing the functionality of the personal care device. For such devices, it is important to ensure that the attachment can be easily mounted on and released from the main housing or base part of the personal care device by the user. At the same time the device should be designed such that the attachment is neither so loosely mounted that it can be unintentionally released during use of the device nor so firmly mounted that it could be damaged in case of an overloading force, e.g. in case of an accidental fall of the device.

WO2008/062339 discloses a rotary shaver with a support structure for shaving heads, which ensures that the shaving head is releasably mounted in a manner such that it is more effectively protected against damage in case of an overloading force than previously known shavers. The shaving head as disclosed in this patent application comprises a shaft-like element to be retained in a retaining recess of a base part of the shaver. The releasable coupling is established between a spring element arranged in the retaining recess and sloped surfaces of two coupling recesses provided in a circumferential surface of the shaft-like element. With an attachment of this kind, the application of a pulling force at a location on the attachment off-center from a central axis of the shaft-like element may in some cases result in unintentional release of the attachment from the retaining recess, in particular during use. This is particularly the case if such an off-center pulling force is applied at a position on an imaginary plane extending through the central axis of the shaft-like element and being substantially parallel to the two legs of the spring element. Such a pulling force will result in a tilting of the whole attachment, which causes the legs of the spring element to start gliding off the sloped surface at the side portion of the sloped surface where the depth of the coupling recess is relatively small as a result of the convex shape of the circumferential surface of the shaft-like element, and to further glide off via the edge between the sloped surface and the circumferential surface. In case of an intended central pulling force, i.e. a pulling force exerted at the location of the central axis of the shaft-like element and parallel to the central axis, the gliding off of the legs of the spring element will be more uniform over the whole sloped surface of the coupling recess, so that the central portion of the sloped surface, where the recess has the largest depth, fully contributes to the resistance against the gliding off of the legs of the spring element. So, in case of an off-center pulling force, the attachment can be released from the base part too easily, i.e. with too little force. This will be explained in further detail in relation to the figures.

Thus, the inventors of the present invention have appreciated that an improved attachment for a personal care device, such a shaver, is of benefit, and have in consequence devised the present invention.

SUMMARY OF THE INVENTION

It would be advantageous to achieve an attachment for a personal care device with which the risk of an unintended release of the attachment from the main housing or base part of the device is lower than with known devices. Furthermore, it would be advantageous to achieve an attachment such that the removal thereof by an intended central pulling-off force is not significantly affected. In particular, it would be advantageous to achieve an attachment with which both of these advantages can be obtained in combination. In general, the invention preferably seeks to mitigate, alleviate or eliminate one or more of the above mentioned disadvantages of the known devices singly or in any combination. In particular, it may be seen as an object of the present invention to provide an attachment for a personal care device that solves the above mentioned problems, or other problems, of the prior art devices.

To solve one or more of these problems, in a first aspect of the invention, an attachment for a personal care device is presented, the attachment comprising:

- at least one treatment member for performing a treatment action, and
- a coupling member for releasably coupling the attachment to a coupling structure of a main housing of the personal care device, wherein
- the coupling member comprises a shaft-like element:
  - having a circumferential surface and a central axis,
  - protruding from the attachment in a direction away from the at least one treatment member, and
  - comprising at least one coupling recess arranged in a portion of the circumferential surface which is convex at least when seen in a cross-section of the shaft-like element perpendicular to the central axis, and wherein

- the at least one coupling recess, when seen in the cross-section of the shaft-like element perpendicular to the central axis, has a central portion and first and second side portions arranged on opposite sides of the central portion and each extending from the central portion up to an end point of the coupling recess, and
- the at least one coupling recess comprises a sloped surface arranged in at least the central portion, said sloped surface being inclined towards the treatment member seen in a direction from the circumferential surface towards the central axis, and wherein

- at least one of the first and second side portions of the coupling recess is recessed relative to the sloped surface, seen in a direction parallel to the central axis.

By "sloped surface" is preferably meant a surface that is arranged inclined or with a curve in relation to the central axis of the shaft-like element. As will be explained in further detail below, the engagement between the sloped surface and at least one spring element of the coupling structure should be such that it causes a spring force component of the spring element to retain the coupling member in a fixed position in a retaining recess of the coupling structure. As a result, a releasable coupling is obtained. The fact that the surface which engages with the spring element is sloped, enables the spring element to release from the recess when a pulling force, preferably parallel to the central axis of the shaft-like element, is exerted on the attachment to release the attachment from the coupling structure of the main housing. Such a pulling force causes the spring element to glide off the sloped surface under deformation of the spring element. This kind of fastening mechanism is typically referred to as a snap connection, as will be more clearly seen from the figures.

If desired, a coupling recess could comprise more than one sloped surface, such as two sloped surfaces arranged next to each other.

By "central portion" in relation to the coupling recess is preferably meant the region near the middle of the coupling recess where the distance between the circumferential surface of the shaft-like element and the innermost edge of the coupling recess, i.e. closest to the central axis, is largest as a result of the convex shape of the circumferential surface of the shaft-like element, i.e. the region near the middle of the coupling recess where the coupling recess has its largest depth. For a symmetrically shaped recess, this will be the region around the axis of symmetry of the coupling recess.

The feature that "at least one of the first and second side portions of the coupling recess is recessed relative to the sloped surface seen in a direction parallel to the central axis" also includes embodiments wherein the recession of the first and/or the second side portion relative to the sloped surface, seen in the direction parallel to the central axis, extends to a lower end of the shaft-like element such that the coupling recess at these side portions and at positions near the end of the recess facing away from the treatment member is not limited by a surface of the shaft-like element. Examples of such embodiments are shown in FIGS. 8*d*, 8*e*, and 8*f*.

The sloped surface could be recessed relative to the circumferential surface of the shaft-like element, i.e. seen in a direction from the central axis of the shaft-like element towards the circumferential surface, the sloped surface may not fully extend up to the circumferential surface. A possible purpose of such a recessed sloped surface could be to obtain an outermost edge of the sloped surface which is less prone to damage caused by the engagement with the spring elements. Another possible purpose of such a recessed sloped surface could be to influence the forces to be applied for mounting or releasing the attachment in order to provide the user with a desired ease of use of the device. The exact shape of the at least one coupling recess can be determined during the design process, also taking into account certain parameters to be described in the following.

By arranging at least one of the first and second side portions of the coupling recess in a recessed position relative to the sloped surface, seen in a direction parallel to the central axis, it is ensured that, in the coupled condition of the attachment, at least one of the side portions does not engage with the spring element of the coupling structure of the main housing. As a result, the sloped surface, and in particular the central portion where the coupling recess has its largest depth, plays a more dominant role in the engagement with the spring element in case of an off-center pulling force. In particular, by the recessed position of at least one of the first and second side portions of the coupling recess, the disadvantageous gliding-off of the spring element via the narrow side portions of the sloped surface of known devices is prevented at the location of the recessed side portions.

The central portion of the coupling recess is the part of the coupling recess where the depth of the coupling recess in radial direction relative to the central axis of the shaft-like element is largest, i.e. where the distance along which the spring element has to deform in said radial direction in order to release the attachment is largest. Besides the larger depth of the central portion of the coupling recess, the resulting retaining force is controlled in a more defined way by the geometry of the coupling recess according to the invention, which also results in a higher retaining force compared to existing solutions. Since the sloped surface in the central portion of the coupling recess plays a dominant role in the engagement with the spring element of the coupling structure of the main housing, the resistance against unintentional release is largest, as explained above.

In a preferred embodiment of the invention, the sloped surface is bordered by an edge at each location where the sloped surface borders a respective one of the first and second side portions that are recessed relative to the sloped surface, said edge being directed inwardly seen from the circumferential surface. By "inwardly" is preferably meant in a direction towards a central region of the shaft-like element, wherein the central region comprises the central axis. In this embodiment, the recessed side portion may be made by providing a step relative to the sloped surface, i.e. by lowering the side face, by removing the side face starting from the edge, or by rotating the side face starting from the edge.

In an embodiment of the invention, the at least one coupling recess is symmetrically shaped relative to an imaginary plane of symmetry comprising the central axis of the shaft-like element, the first and second side portions being both recessed relative to the sloped surface seen in the direction parallel to the central axis. In this embodiment, the sloped surface is located centrally with respect to the axis of symmetry. As a result, the largest possible resistance against unintentional release of the attachment is obtained no matter at which position the pull-off force is applied. For some designs of attachments and co-operating main housings of a personal care device, an unintentional off-center pull-off force may be more likely to be applied at one side of the attachment than at the other. In such a case, it may be more advantageous to use a design in which the sloped surface is arranged off-set from an axis of symmetry of the coupling recess.

In embodiments having a symmetrically shaped coupling recess, the sloped surface may be bordered by a first edge at a location where the sloped surface borders the first recessed side portion and by a second edge at a location where the sloped surface borders the second recessed side portion, said first and second edges being directed inwardly, seen from the circumferential surface.

Such inwardly directed first and second edges may extend parallel to each other. In such embodiments, the sloped surface may form an upper surface of a rib-shaped central support member bordered by the first and second edges.

Alternatively, the first and second edges may extend non-parallel to each other and have a smallest mutual distance near, such as at, the circumferential surface of the shaft-like element. Alternatively, the first and second edges may extend non-parallel to each other and have a largest mutual distance near, such as at, the circumferential surface of the shaft-like element.

In some embodiments of the invention, the sloped surface is plane. Alternatively, the sloped surface may be curved. The invention also covers embodiments wherein a portion of the sloped surface is plane and another portion of the sloped surface is curved.

In embodiments wherein the sloped surface is bordered by an edge at each location where the sloped surface borders a respective one of the first and second side portions that are recessed relative to the sloped surface, as described above, when seen in a cross section perpendicular to a longitudinal extension of the edge, the edge may have a radius of curvature from 0 to 5 mm, such as from 0 to 1 mm or from 1 to 2 mm, preferably from 0.1 to 0.5 mm, along at least a part of the longitudinal extension.

In preferred embodiments of the invention, the shaft-like element comprises two coupling recesses, each having the characteristic features according to the invention, arranged on regions of the circumferential surface of the shaft-like element which are mutually opposite relative to the central axis. This means that an attachment according to the present invention can be used in personal care devices, such as the shaving device disclosed in WO 2008/062339. By having two coupling recesses in mutually opposite positions, a more stable mounting of the attachment on the main housing is ensured, particularly for personal care devices with attachments that perform a treatment action involving a rotational movement. Furthermore, two coupling recesses in mutually opposite positions imply the use of two associated spring elements, or two arms or legs of a single spring element as shown in the figures. This results in a more efficient relationship between the retaining force and the required pull-off force to release the attachment. In embodiments having two coupling recesses in mutually opposite positions, the two coupling recesses may be identical or different. This may be determined as part of the design process of the attachment.

In some embodiments of the invention, the attachment, when coupled to the personal care device, is solely supported by the coupling member. As a result, it is ensured that, in case a large external load is applied on the attachment such as due to the personal care device falling on the floor, the coupling member is released from the coupling structure, so that damage to the attachment or the treatment member is limited. This will be explained in further detail in relation to FIG. 4.

In an attachment which is solely supported by the coupling member, as described above, a collar may be provided around the shaft-like element. Such a collar is typically arranged for abutting on an edge provided around the circumference of a retaining recess of the coupling structure which receives the shaft-like element of the coupling member. By providing said collar it is ensured that the coupling member, and thereby the whole attachment, is held in a desired position in the retaining recess, because the spring force provided by the spring element of the coupling structure on the sloped surface of the coupling recess will pull the coupling member towards the base part. This will be more clearly seen in relation to FIG. 4.

In a second aspect, the invention relates to a personal care device comprising:

an attachment according to any one of the embodiments of the first aspect of the invention as described above, a main housing comprising a coupling structure for releasably coupling with the coupling member of the attachment, a drive shaft for driving the at least one treatment member of the attachment, and drive means for driving the drive shaft, wherein the coupling structure comprises:

a retaining recess for receiving the shaft-like element of the coupling member, and at least one spring element for engagement with the sloped surface of the at least one coupling recess of the shaft-like element to establish a releasable coupling between the attachment and the main housing. The drive shaft may extend between drive means of the personal care device and the attachment through the shaft-like element. Such drive means typically comprise a motor driven by a battery, such as a rechargeable battery, or connected or connectable to electrical mains.

In general, the various aspects of the invention may be combined in any way possible within the scope of the invention. These and other aspects, features and/or advantages of the invention will be apparent from and elucidated with reference to the embodiments described hereinafter.

BRIEF DESCRIPTION OF THE DRAWINGS

Embodiments of the invention will be described, by way of example only, with reference to the drawings, in which FIGS. 1*a* and 1*b* schematically show three-dimensional views of a known personal care device comprising a detachable attachment;

FIGS. 2*a* and 2*b* schematically show three-dimensional views of the attachment of the personal care device of FIG. 1 and a part of the main housing of the personal care device in which the attachment can be releasably retained;

FIGS. 3*a* and 3*b* schematically show cross-sectional views of the attachment and the part of the main housing shown in FIGS. 2*a* and 2*b*, wherein FIG. 3*a* shows a detached condition of the attachment, and wherein FIG. 3*b* shows a coupled condition of the attachment;

FIG. 4*a* schematically shows a side view of another known coupling member;

FIG. 4*b* schematically shows a cross-sectional view of a part of a known personal care device comprising the coupling member shown in FIG. 4*a* in a coupled condition;

FIG. 5 shows computer simulations of the effect of an off-center pull-off force applied on a known coupling member;

FIG. 6 schematically shows a coupling member with a coupling recess of an embodiment of an attachment in accordance with the present invention;

DETAILED DESCRIPTION OF THE EMBODIMENTS

Figure 7:
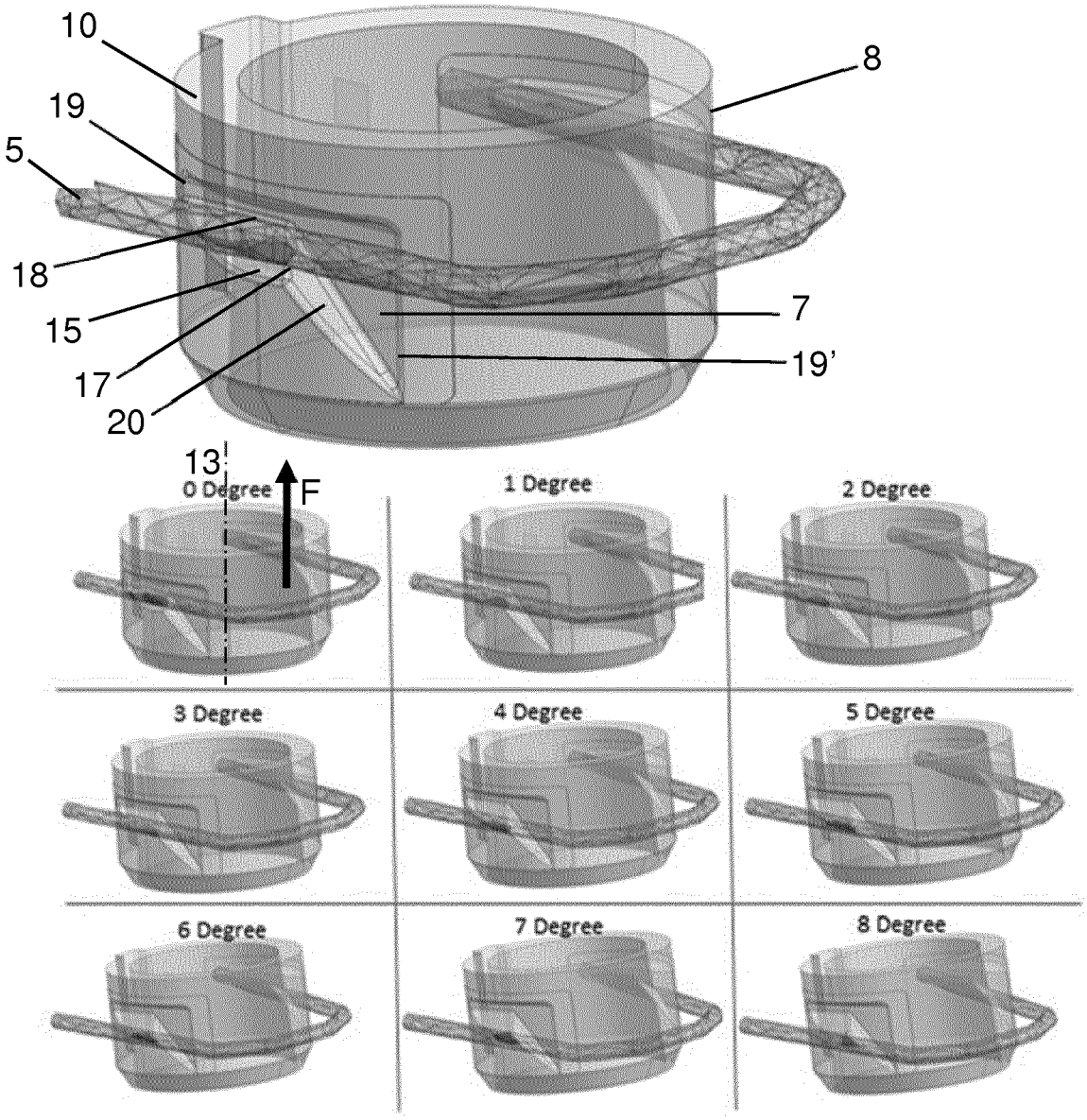
FIG. 7 shows computer simulations of the effect of an off-center pull-off force applied on the coupling member shown in FIG. 6 in accordance with an embodiment substantially similar to that shown in FIG. 6.

FIGS. 1*a* and 1*b* schematically show three-dimensional views of a known personal care device 1 comprising a detachable attachment 2 and a main housing 12 including a drive shaft 30 for driving the attachment 2 and drive means, such as a motor 35, for driving the drive shaft 30. The device shown in these and the following figures is an electric trimmer, but other kinds of devices, such as shavers and massaging devices, are also covered by the present invention.

FIGS. 2*a* and 2*b* schematically show three-dimensional views of a known design of a releasable coupling between the attachment 2 and a base part 3 of the main housing 12, exemplified with the trimmer in FIGS. 1*a* and 1*b*. FIG. 2*a* shows the attachment, and FIG. 2*b* shows an upper part of the base part 3 which comprises a retaining recess 4 for holding the attachment 2. The retaining recess 4 comprises a spring element 5 which, in the illustrated embodiment, is in the form of a bent piece of spring metal, i.e., a spring element bent in a U-shape having two parallel legs. Alternatively, the two spring legs could be embodied as two individual spring elements. As seen in FIG. 2*a*, the attachment 2 comprises a shaft 6, also referred to as a shaft-like element 6, adapted to engage with and be received by the retaining recess 4. Two coupling recesses 7 (only one of which is visible in FIG. 2*a*) are located on a circumferential surface 8 of the shaft-like element 6, i.e. in mutually opposite positions relative to a central axis of the shaft-like element 6.

FIGS. 3*a* and 3*b* schematically show, in cross-sectional views, the known releasable couplings as shown in FIGS. 2*a* and 2*b* along a plane extending through the central axis 13 of the shaft-like element 6. FIG. 3*a* shows the attachment 2 in a released condition, and FIG. 3*b* shows the attachment 2 in a condition coupled to the base part 3 of the main housing 12 of the personal care device 1. The attachment 2 comprises at least one treatment member 9 for performing a treatment action. Such a treatment action could e.g. be shaving, in which case the attachment would be a shaving head, e.g. comprising one or more rotary shaving units. Other possible embodiments of the attachment could be a shaving unit with a linearly moving shaving member, a trimming unit in several executions, a unit with rotational brushes e.g. for facial cleaning, or an eye treatment unit. The attachment 2 further comprises a coupling member 10 which is releasably retainable by a coupling structure 11 of the base part 3 of the personal care device 1. The coupling member 10 comprises a shaft-like element 6 having a circumferential surface 8 and a central axis 13. The part of the attachment 2 comprising the at least one treatment member 9 may have any shape at least partly dependent on the treatment action to be performed. The shape shown in FIGS. 1*a*-3*b* is schematic only. The shaft-like element 6 protrudes from a surface 14 of the attachment 2, facing the coupling structure 11 in the coupled condition of the attachment, so that it can be engaged with the coupling structure 11. In other words, the shaft-like element 6 protrudes from the attachment 2 in a direction away from the at least one treatment member 9, so that the shaft-like element 6 has an orientation on the attachment 2 which ensures that it is adapted to be received by the retaining recess 4 of the coupling structure 11.

In the embodiment in FIGS. 3*a* and 3*b* and in the following figures, the shaft-like element 6 comprises two coupling recesses 7, arranged on regions of the circumferential surface 8 of the shaft-like element 6 which are mutually opposite relative to the central axis 13 of the shaft-like element 6. This arrangement of the two coupling recesses 7 allows the use of the attachment 2 in a personal care device having a main housing with a base part e.g. as disclosed in WO 2008/062339. An alternative design would be a design with only one coupling recess on one side of the circumferential surface of the shaft-like element. The two coupling recesses 7 each comprise a sloped surface 15, said sloped surface 15 being inclined towards the treatment member 9, seen in a direction from the circumferential surface 8 towards the central axis 13. The sloped surfaces 15 of the two coupling recesses 7 are arranged to each engage with respectively one of the two legs of the spring element 5 of the coupling structure 11, so that the attachment 2 is releasably retained in the retaining recess 4 of the coupling structure 11 of the main housing 12 of the personal care device 1.

FIG. 4*a* schematically shows a side view of another known coupling member 10, and FIG. 4*b* schematically shows a cross-sectional view of a part of the main housing of a known personal care device with the coupling member 10 as shown in FIG. 4*a* coupled thereto. FIG. 4*a* shows the coupling member 10 in a condition wherein the lower part of the coupling member 10 is about to engage with the spring element 5 of the coupling structure 11 of the base part 3 of the main housing. To couple the attachment 2 to the main housing, the attachment 2 is pressed downwards starting from the orientation shown in FIG. 4*a*. As a result, the legs of the spring element 5 are bent elastically in radially outward directions by their interaction with a further sloped surface provided on the bottom portion of the shaft-like element 6, until the legs pass the widest part of the circumferential surface 8 of the shaft-like element 6. By then, the legs engage with the two opposed coupling recesses 7 in a snap-fastening manner as shown in FIG. 4*b*. The sloped surfaces 15 of the coupling recesses 7 make it possible to release the attachment 2 from its engagement with the legs of the spring element 5 by applying a pulling force on the attachment 2, preferably aligned with the central axis of the shaft-like element.

As shown in FIG. 4*b*, the attachment 2, when coupled to the main housing of the known personal care device, is solely supported by the coupling member 10. As a result, it is achieved that, when an external load is exerted on the attachment 2 of the personal care device 1, the load is transferred to the coupling member 10. Since, in the coupled state, the attachment 2 is not supported in the area of its outer circumference, the area of the outer circumference of the attachment 2 does not contribute in transferring the external load to the base part 3 of the main housing. As a result, the coupling member 10 solely has to transfer the external load to the base part 3. Since the coupling member 10 is arranged in a relatively narrow central area of the attachment 2, the mechanical torque associated with an external load exerted on the outer circumference of the attachment 2 will lead to a relatively high force on the coupling member 10. If the external load is large enough, the coupling member 10 is released from the coupling structure 11, thereby preventing that an overload would result in damage to the attachment 2 or the treatment member 9. In normal use of the personal care device 1, the coupling member 10 and the coupling structure 11 provide a solid coupling between the attachment 2 and the base part 3 such that a force exerted on the attachment 2 during normal use does not result in release of the coupling member 10. Only if the load on the attachment 2 exceeds a critical value, for example due to an accidental misuse or fall, the coupling member 10, and thus the whole attachment 2, is released from the base part 3.

As also seen in FIGS. 4*a* and 4*b*, a collar 16 is provided around the shaft-like element 6 for abutting on an edge around the circumference of the retaining recess 4. The collar 16 abuts the base part 3 when the attachment 2 is attached to the base part 3. While the spring element 5 exerts a spring force on the sloped surfaces 15, the collar 16 prevents a further insertion of the coupling member 10, thus generating a tension force of the spring element 5 on the sloped surface 15 for retaining the coupling member 10 in a fixed position in the retaining recess 4. Further, the collar 16 may prevent dirt and dust from entering into the retaining recess 4 and/or may provide a watertight closure of the base part 3. If the collar 16 is not designed symmetrically, the collar may define an angular orientation of the attachment 2 about the central axis 13 in relation to the base part 3. Alternatively or in combination therewith, a protruding rib on the circumferential surface can be used to ensure a desired angular orientation of the attachment 2.

The spring element 5 engages with a relatively large portion of the sloped surfaces 15 of the coupling recesses 7, thereby ensuring a sufficient holding force for retaining the attachment 2 coupled to the base part 3. When the attachment 2 is removed by applying a pulling force which is aligned with the central axis 13, the spring element 5 will glide off the sloped surfaces 15 until it reaches the circumferential surface 8, whereby the attachment 2 is released. However, studies including the use of computer simulations have shown that, when an off-center force F is applied as shown in the first part of FIG. 5, i.e. a force F parallel to but not aligned with the central axis 13, the spring element 5 will not glide off the sloped surface 15 in the intended manner. This is due to the fact that the off-center force gives rise to a torque on the coupling member 10 resulting in a tilting of the coupling member. This tilting will also occur for orientations and points of exertion of the applied force F other than along the central axis 13. The most critical condition occurs when the force F is applied in a plane comprising the central axis 13 and extending parallel to the longitudinal extensions of the two legs of the spring element 5. FIG. 5 shows the results of computer simulations illustrating the process of detachment of the coupling member 10 by application of a force as shown in the first sub-figure, i.e. the figure marked with "0 Degree". FIG. 5 shows how the tilting of the coupling member 10, and thus of the whole attachment 2, causes the legs of the spring element 5 to glide off the sloped surfaces 15 of the coupling recesses 7, starting at the side portions of the sloped surfaces 15 where the depth of the coupling recesses 7 is relatively small, and to further glide off via the edges between the sloped surfaces 15 and the circumferential surface 8. In this situation, the resulting effective holding force of the spring element 5 on the sloped surfaces 15 is relatively low. In the preferred situation wherein the pulling force is exerted centrally along the central axis 13, the legs of the spring element 5 will glide off more uniformly over the sloped surfaces 15 of the coupling recesses 7, so that the central portions of the sloped surfaces 15, where the coupling recesses 7 have the largest depth, fully contribute to providing resistance against the gliding off of the spring element 5. An off-center pulling force generally does not cause any problem when it is the intention of a user to remove the attachment 2. However, in case of an off-center pulling force during use of the personal care device 1, the attachment 2 can be released from the base part 3 too easily, i.e. with too little force.

The above described problem has been solved by the inventors of the present invention by re-designing the geometry of the coupling recess 7 as will be described in the following. FIG. 6 shows a geometry of a coupling recess 7 in accordance with an embodiment of the present invention. The other features of an attachment for a personal care device according to the invention are as schematically described in relation to the FIGS. 1-5. The coupling recess 7 in FIG. 6 comprises a sloped surface 15 which is partly delimited by an edge 17 directed inwardly seen from the circumferential surface 8, i.e. an edge 17 oriented in a direction towards a central region of the shaft-like element 6. The edge 17 typically has a radius of curvature from 0 to 3 mm, such as from 0 to 1 mm or from 0.5 to 2 mm, preferably from 0.1 to 0.5 mm along at least a part of its longitudinal extension.

In the coupling recess 7 in FIG. 6, the sloped surface 15 extends over a central portion 7*a* (having a central point 7*b*) of the coupling recess 7 and over a first side portion 18 of the coupling recess 7 that extends from the central portion up to a first end point 19 of the coupling recess 7. A second side portion 20 of the coupling recess 7 extends from the central portion of the coupling recess 7 to a second end point 19' of the coupling recess 7. Thus, seen in a cross-section of the shaft-like element 6 perpendicular to the central axis 13, the first and second side portions 18, 20 of the coupling recess 7 are arranged on opposite sides of the central portion and each extend from the central portion up to a respective one of the end points 19, 19' of the coupling recess 7. The second side portion 20 has a geometry which ensures that it does not engage with the spring element in the coupled condition of the attachment 2. In particular, the sloped surface 15 is bordered by the edge 17 at the location where the sloped surface 15 borders the second side portion 20. As a result, the second side portion 20 of the coupling recess 7 is recessed relative to the sloped surface 15, seen in a direction parallel to the central axis 13. As a result of said recession of the second side portion 20, it is prevented that, in the coupled condition of the attachment 2, the spring element engages the coupling recess 7 at the location of the second side portion 20.

FIG. 7 shows computer simulations of the effects of an off-center pull-off force, resembling the pull-off force in FIG. 5, applied to a coupling member 10 comprising the coupling recess 7 shown in FIG. 6 in accordance with an embodiment substantially similar to the embodiment shown in FIG. 6. The simulations show how, with the design of the coupling recess 7 according to the invention, the legs of the spring element glide off along the edge 17, which results in a substantially higher pull-off force as compared to the pull-off force according to the simulations shown in FIG. 5. This means that, with the coupling recess 7 configured in accordance with the present invention, the spring element 5 is more effective with respect to retaining the attachment 2 in the retaining recess 4 in the situation of an off-center pull-off force. At the same time, a centrally applied pull-off force will still result in the intended linear removal of the attachment 2 from the retaining recess 4, which involves a substantial resistance force.

FIGS. 8*a*-8*g* schematically show various embodiments of coupling recesses 7 configured in accordance with the present invention. In preferred embodiments, including the embodiments shown in FIGS. 8*a*-8*g*, the sloped surface 15 is arranged in the central portion of the coupling recess 7, and the coupling recess 7 is symmetrically shaped relative to an imaginary plane of symmetry comprising the central axis 13 of the shaft-like element 6. The embodiments in FIGS. 8*a*-8*g* are all depicted as line drawings, grey scale drawings and cross-sectional views, as the different kinds of illustrations are considered to provide different kinds of information. The cross-sectional views are shown along planes oriented parallel to the central axis 13 at a distance from the circumferential surface 8 of the shaft-like element 6. Thus, for each of the illustrated embodiments, the cross-sectional view shows the profile of the coupling recess 7 in a plane positioned at a distance form the circumferential surface 8 and seen towards the central axis 13. The reference numbers are only added to the first sub-figure of each embodiment to more clearly show the other details in the following sub-figures.

In the embodiments of FIGS. 8*a*-8*g*, the first and second side portions 18, 20 of the coupling recess 7 are both recessed relative to the sloped surface 15, seen in the direction parallel to the central axis 13, and the sloped surface 15 is bordered by first and second edges 17, 21 at the location where the sloped surface 15 borders respectively the first and second side portions 18, 20. The first and second edges 17, 21 are directed inwardly seen from the circumferential surface 8. As a result, in the coupled condition of the attachment 2, it is prevented that the spring element engages the coupling recess 7 at the location of both the first and second side portions 18, 20. In the embodiments of FIGS. 8*a*, 8*c* and 8*d*, the first and second edges 17, 21 extend non-parallel with respect to each other, while in the embodiments of FIGS. 8*b* and 8*e*-8*g*, the first and second edges 17, 21 extend parallel with respect to each other. In embodiments wherein the first and second edges 17, 21 extend non-parallel with respect to each other, the first and second edges 17, 21 may have a smallest mutual distance near the circumferential surface 8 of the shaft-like element 6, such as shown in the embodiments in FIG. 8*c*. Alternatively, in embodiments comprising non-parallel first and second edges 17, 21, the first and second edges 17,21 may have a largest mutual distance near the circumferential surface 8 of the shaft-like element 6, such as shown in the embodiments in FIGS. 8*a* and 8*d*.

FIGS. 8*e* and 8*f* show embodiments wherein the first and second side portions 18, 20 of the coupling recess 7 are recessed relative to the sloped surface 15, seen in the direction parallel to the central axis 13, to such an extent that the coupling recess 7 at the location of the first and second side portions 18, 20 is not bounded by surfaces of the coupling member 10 in end positions of the coupling recess 7 facing away from the treatment member 9. Thus, in the embodiments shown in FIGS. 8*e* and 8*f*, the sloped surface 15 forms an upper surface (in the orientation shown in these figures) of a rib-shaped central support element 25 bordered by the recessed first and second side portions 18, 20. Also in the embodiment of FIG. 8*g*, the sloped surface 15 forms an upper surface of a rib-shaped central support element 25. In this embodiment, however, in the end positions of the coupling recess 7 facing away from the treatment member 9, the coupling recess 7 is bounded by surfaces 27 of the coupling member 10.

The design of a coupling recess 7 in accordance with the invention will include considerations relating to the need for enough free space to allow the spring element to deform. The design also has to take into account that the material thickness of the shaft-like element between the coupling recesses and a possible hollow space in the central region of the shaft-like element should be large enough to prevent deformation or breakage of the shaft-like element. The design for a given product will typically be based on computer simulations, possibly combined with prototypes made e.g. by 3D-printing.

If a personal care device according to the invention is to be used with different attachments, the coupling recesses of the coupling members of the different attachments can be designed differently, if desired or required. By such different designs, the combination of the necessary pull-off force for an intended release of the attachment and the resistance against unintentional release of the attachment can be optimized for each different attachment, since said pull-off force and resistance are directly dependent on the geometries of the coupling recessess used for the different attachments.

Figure 8:
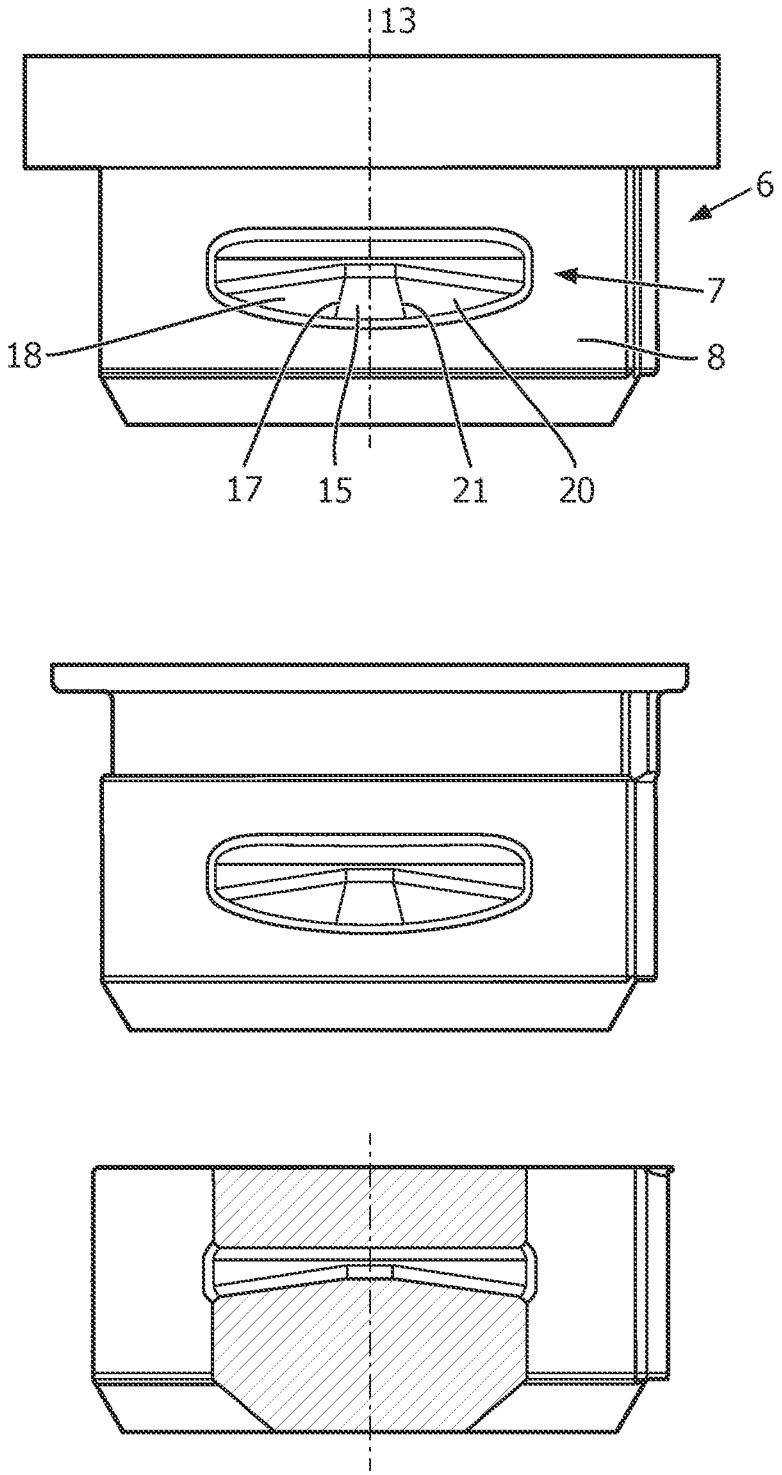
FIGS. 8*a*-8*g* schematically show coupling members with a coupling recess of various alternative embodiments of an attachment in accordance with the present invention.
Figure 8:
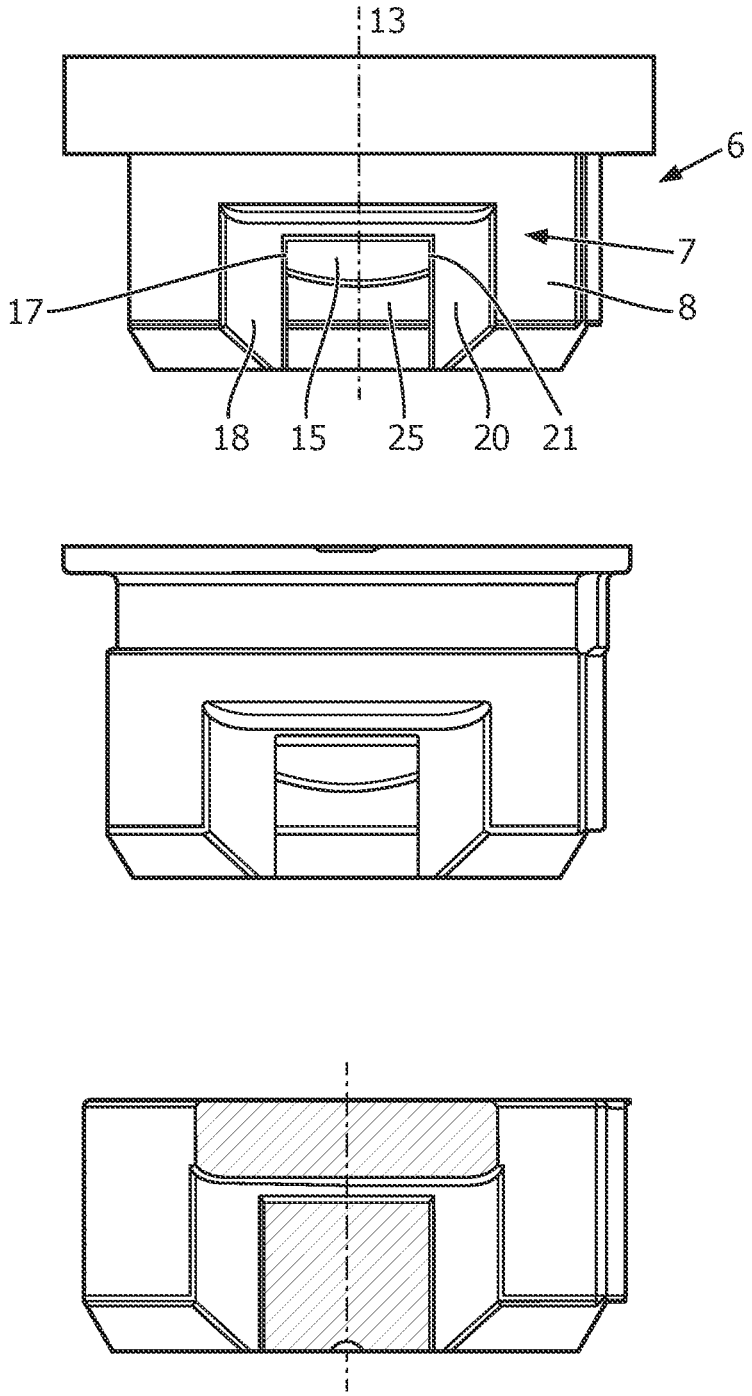
Figure 8:
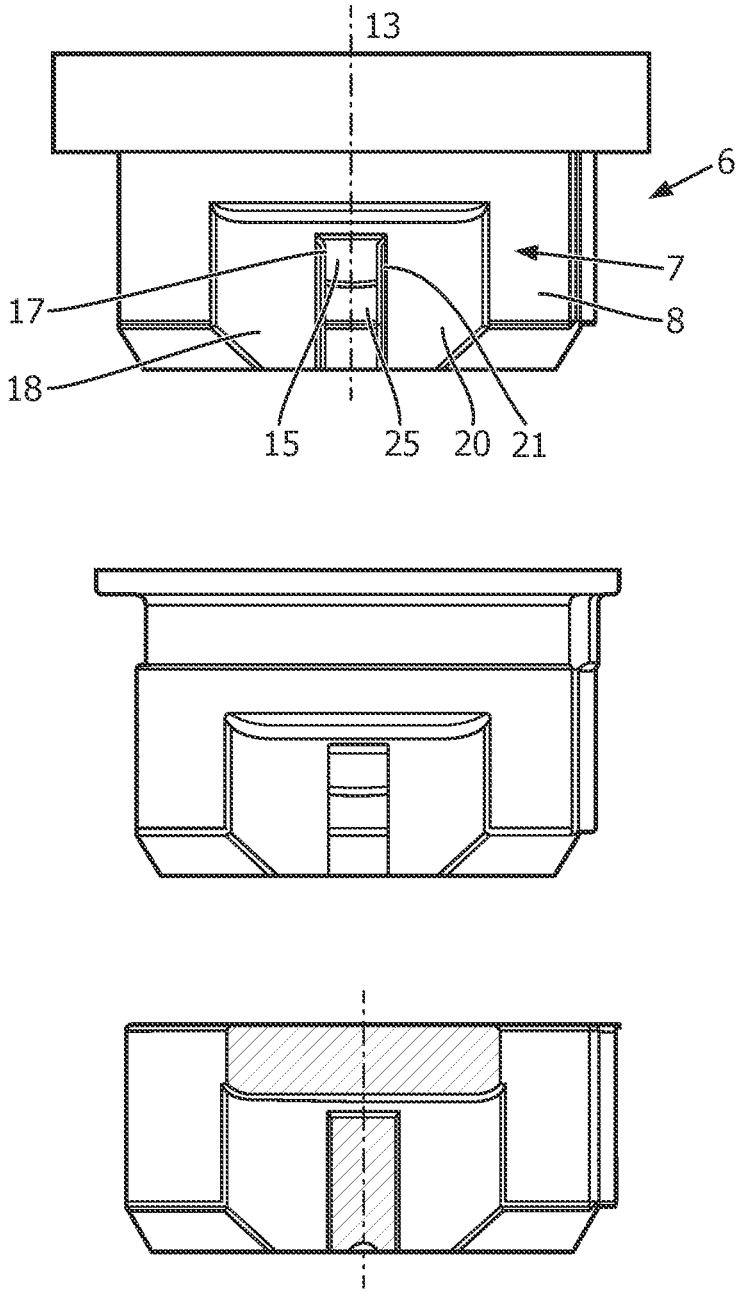
Figure 8:
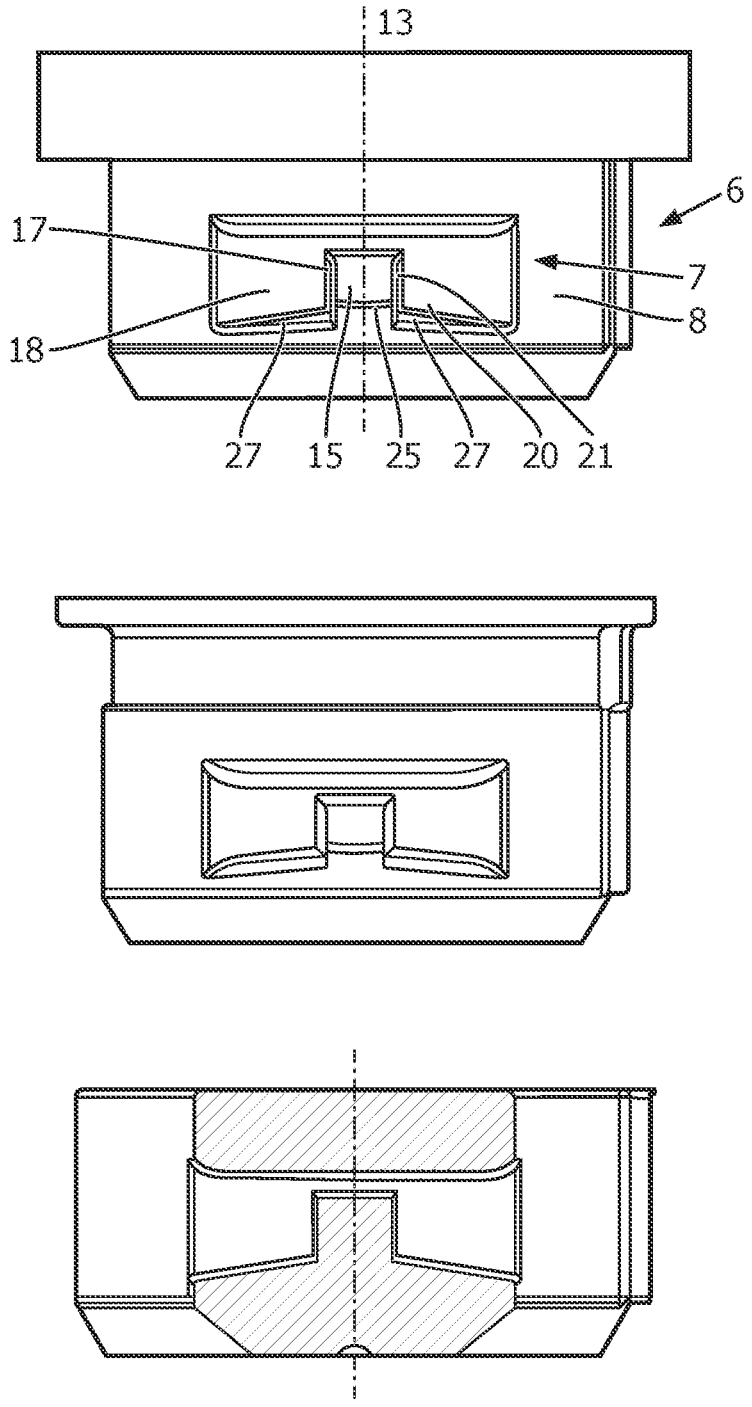
Figure 9:
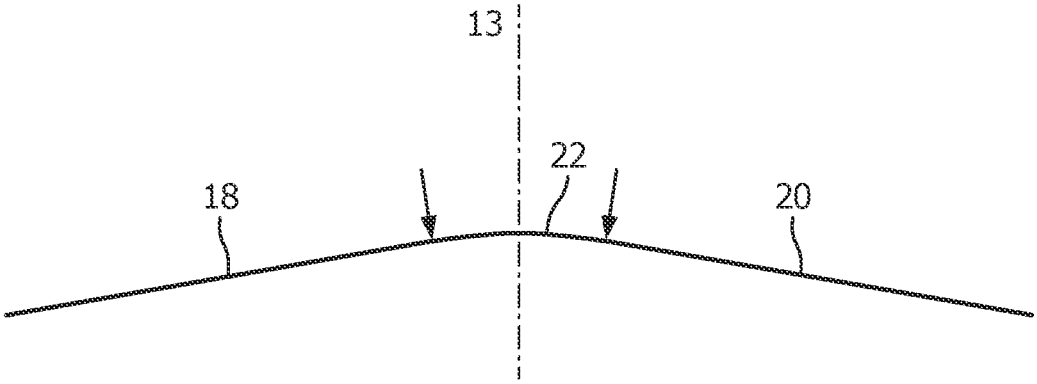
FIG. 9 schematically shows an example of a possible shape of the surface of a coupling recess with a curved, sloped surface.

The sloped surfaces 15 in the embodiments shown in the FIGS. 6-8 are plane surfaces. However, the sloped surfaces 15 may also be curved surfaces. An example of a possible shape of a coupling recess 7 with a curved sloped surface 22 is shown schematically in FIG. 9. The curved sloped surface 22 is shown in combination with first and second side portions 18, 20, wherein the first and second side portions 18, 20 comprise surfaces that are inclined at an angle relative the sloped surface 22 to ensure that, in the coupled condition of the attachment 2, there is no contact with the spring element at the location of the first and second side portions 18, 20. FIG. 9 shows the sloped surface 22 and the first and second side portions 18, 20, seen in a direction perpendicular to the central axis 13. In the shown embodiment, the first and second side portions 18, 20 have plane upper surfaces ending where the curved sloped surface 22 begins. The intersection between the curved and plane surfaces are illustrated with arrows in FIG. 9.

While the invention has been illustrated and described in detail in the drawings and foregoing description, such illustration and description are to be considered illustrative or exemplary and not restrictive. The invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A particular unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

The invention claimed is:

1. An attachment for a personal care device, the attachment comprising:

at least one treater configured to perform a treatment action; and a coupler configured to releasably couple the attachment to a coupling structure of a main housing of the personal care device in a coupled condition, wherein the coupler comprises a shaft having a circumferential surface and a central axis, the shaft protruding from the attachment in a direction away from the at least one treater, and having at least one coupling recess arranged in a portion of the circumferential surface, and wherein the at least one coupling recess, when seen in the cross-section of the shaft perpendicular to the central axis, has first and second side portions on opposite sides of a central point, wherein the at least one coupling recess has a sloped surface inclined towards the at least one treater seen in a direction from the circumferential surface towards the central axis, wherein the sloped surface is configured to receive a spring of the personal care device for releasably attaching the attachment to the personal care device in the coupled condition, wherein one side portion of the first and second side portions is configured to engage the spring in the coupled condition, and another side portion of the first and second side portions is configured to not engage the spring in the coupled condition wherein the one side portion has a different shape than the another side portion, such that the first side portion extends from the central point to a first end point of the at least one coupling recess and the second side portion extends from the central point to a second end point of the at least one coupling recess, the first end point being nearer to the treater than the second end point, and wherein the one side portion is the first side portion and the another side portion is the second side portion.

2. The attachment according to claim 1, wherein the sloped surface is bordered by an edge at each location where the sloped surface borders a respective one of the first and second side portions that are recessed relative to the sloped surface, the edge being directed inwardly seen from the circumferential surface.

3. The attachment according to claim 1, wherein the sloped surface is plane.

4. The attachment according to claim 1, wherein the at least one coupling recess comprises two coupling recesses arranged on regions of the circumferential surface of the shaft which are mutually opposite relative to the central axis.

5. The attachment according to claim 1, wherein the attachment, when coupled to the personal care device, is solely supported by the coupler.

6. The attachment according to claim 1, wherein a collar is provided around the shaft.

7. A personal care device comprising:

an attachment having at least one treater configured to perform a treatment action, and a coupler; and a main housing comprising a housing coupler configured to be releasably coupled with the coupler of the attachment in a coupled condition;

wherein the coupler includes a shaft having a circumferential surface and a central axis, the shaft protruding from the attachment in a direction away from the at least one treater, and having at least one coupling recess arranged in a portion of the circumferential surface which is convex at least when seen in a cross-section of the shaft perpendicular to the central axis, wherein the housing coupler comprises:

a retaining recess for receiving the shaft of the coupler, and at least one spring for engagement with the at least one coupling recess of the shaft to establish a releasable coupling between the attachment and the main housing in the coupled condition, wherein the at least one coupling recess, when seen in the cross-section of the shaft perpendicular to the central axis, has first and second side portions on opposite sides of a central point, wherein one side portion of the first and second side portions is configured to engage the spring in the coupled condition, and another side portion of the first and second side portions is configured to not engage the spring in the coupled condition, wherein the one side portion has a different shape than the another side portion, such that the first side portion extends from the central point to a first end point of the at least one coupling recess and the second side portion extends from the central point to a second end point of the at least one coupling recess, the first end point being nearer to the treater than the second end point, and wherein the one side portion is the first side portion and the another side portion is the second side portion.

8. An attachment for a personal care device, the attachment comprising:

at least one treater configured to perform a treatment action; and a coupler configured to releasably couple the attachment to a coupling structure of a main housing of the personal care device in a coupled condition, wherein the coupler comprises a shaft having a circumferential surface and a central axis, the shaft protruding from the attachment in a direction away from the at least one treater, and having at least one coupling recess arranged in a portion of the circumferential surface, and wherein the at least one coupling recess has first and second side portions on opposite sides of a central point, wherein the at least one coupling recess is configured to receive a spring of the personal care device for releasably attaching the attachment to the personal care device in the coupled condition, wherein one side portion of the first and second side portions is configured to engage the spring in the coupled condition, and another side portion of the first and second side portions is configured to not engage the spring in the coupled condition, wherein the one side portion has a different shape than the another side portion, such that the first side portion extends from the central point to a first end point of the at least one coupling recess and the second side portion extends from the central point to a second end point of the at least one coupling recess, the first end point being nearer to the treater than the second end point, and wherein the one side portion is the first side portion and the another side portion is the second side portion.

9. The attachment of claim 8, wherein the circumferential surface is convex at least when seen in a cross-section of the shaft perpendicular to the central axis.

* * * * *